US006681093B2

(12) United States Patent
Inoue et al.

(10) Patent No.: US 6,681,093 B2
(45) Date of Patent: Jan. 20, 2004

(54) DEVELOPING DEVICE OF MONOCOMPONENT DEVELOPMENT SYSTEM

(75) Inventors: Ryuji Inoue, Osaka (JP); Yoshiko Yaoi, Osaka (JP); Minoru Wada, Osaka (JP); Ichiro Demizu, Osaka (JP)

(73) Assignee: Minolta Co., Ltd., Osaka (JP)

( * ) Notice: Subject to any disclaimer, the term of this patent is extended or adjusted under 35 U.S.C. 154(b) by 9 days.

(21) Appl. No.: 10/035,429

(22) Filed: Jan. 4, 2002

(65) Prior Publication Data

US 2002/0127033 A1 Sep. 12, 2002

(30) Foreign Application Priority Data

Jan. 9, 2001 (JP) ..... 2001-000932
Jan. 9, 2001 (JP) ..... 2001-000931

(51) Int. Cl.[7] ..... G03G 15/08
(52) U.S. Cl. ..... 399/286; 492/18
(58) Field of Search ..... 399/279, 285, 399/286, 284; 492/18, 56

(56) References Cited

U.S. PATENT DOCUMENTS 4,780,743 A * 10/1988 Asada et al. ..... 399/284
4,958,193 A * 9/1990 Nojima et al. ..... 399/286
5,170,213 A * 12/1992 Yamaguchi et al. ..... 399/281
5,621,506 A * 4/1997 Hosaka et al. ..... 399/284
5,666,626 A * 9/1997 Takizawa et al. ..... 399/286
5,689,784 A * 11/1997 Shin et al. ..... 399/285
5,862,444 A 1/1999 Machida et al.
5,870,658 A 2/1999 Goto et al.
5,875,379 A 2/1999 Machida et al.
5,893,014 A 4/1999 Goto et al.
6,049,688 A * 4/2000 Hayashi et al. ..... 399/284
6,397,032 B1 * 5/2002 Sakaizawa et al. ..... 399/286

FOREIGN PATENT DOCUMENTS

JP 11-344856 12/1999

* cited by examiner

*Primary Examiner*—Robert Beatty
(74) *Attorney, Agent, or Firm*—Morrison & Foerster LLP

(57) ABSTRACT

A developing device of monocomponent development system for developing a latent image formed on an image bearing member according to the present invention includes a toner carrying member disposed opposite the image bearing member via a gap of 50 to 250 μm therebetween, and including a conductive substrate and an elastic layer having a rubber hardness of not more than 70 degrees and a thickness in the range of 7 to 50 μm, and a regulating member pressed against a surface of the toner carrying member for regulating the amount of toner on the toner carrying member.

20 Claims, 3 Drawing Sheets

DEVELOPING DEVICE OF MONOCOMPONENT DEVELOPMENT SYSTEM

RELATED APPLICATION

The present invention is based on Japanese Patent Application Nos.2001-000,931 and 2001-000,932, each content of which is incorporated by reference.

BACKGROUND OF THE INVENTION

1. Field of the Invention

The present invention relates to a developing device of monocomponent development system which is used for developing a latent image formed on an image bearing member in image forming apparatuses, such as copying machines, printers and the like.

2. Description of the Related Art

Heretofore, the image forming apparatuses, such as copying machines, printers and the like, have employed a variety of developing devices for developing the latent image formed on the image bearing member.

As such a developing device, there have been known a developing device of two-component development system using a developer containing a carrier and a toner, and that of monocomponent development system using a developer free from the carrier.

The developing device of monocomponent development system is arranged as follows. Generally at some place in the course of transportation of a toner on a surface of a toner carrying member to a development region opposite to an image bearing member, a regulating member having a spring resilience or rubber elasticity is pressed against the surface of the toner carrying member thereby ensuring a proper amount of toner carried on the toner carrying member to the development region and triboelectrically charging the toner in a predetermined polarity.

The conventional toner carrying member generally comprises a metallic roller or a metallic roller formed with an elastic layer on its surface.

However, in the arrangement wherein the regulating member is pressed against the surface of the toner carrying member, such as formed of the metallic roller, for regulating the amount of toner transported to the development region, the toner is subjected to such a great load originating in a contact pressure from the regulating member that the toner particles on the surface of the toner carrying member are fractured to produce fine particles. Particularly when the development speed is increased for high-speed image forming process, there occurs severe toner fracture to produce a great amount of fine particles which will be gradually accumulated on the surface of the toner carrying member and fused thereto. As a result, the images so formed suffer density variations.

In the conventional toner carrying member wherein the metallic roller is formed with the elastic layer on its surface, as described above, the thickness of the elastic layer over the surface of the metallic roller is increased in order to prevent the toner fracture caused by the pressure contact by the regulating member.

Unfortunately in the case where the elastic layer over the surface of the metallic roller has a great thickness, the forming precisions of the toner carrying member is lowered. Particularly in an arrangement designed for an enhanced durability of the toner carrying member and for high-speed development, wherein the toner carrying member opposes the image bearing member in the development region via a required gap therebetween so as to provide for a develop process with the toner carrying member maintained in non-contact relation with the image bearing member, the gap between the toner carrying member and the image bearing member is so varied that the images cannot be developed in a stable manner. Hence, the resultant images suffer density variations or noises due to electrical leakage.

OBJECT AND SUMMARY

It is an object of the invention to solve the aforementioned problems encountered by the developing device of monocomponent development system.

More specifically, the object of the invention is to provide a developing device of monocomponent development system adapted to prevent the toner fracture caused by the pressure contact by the regulating member.

It is another object of the invention to provide a developing device of monocomponent development system adapted to avoid the degradation of the forming precisions of the toner carrying member.

It is still another object of the invention to provide a developing device of monocomponent development system in which the toner carrying member opposes the image bearing member in the development region via a required gap therebetween so as to provide for the development process with the toner carrying member maintained in non-contact relation with the image bearing member, the device adapted to develop images in a stable manner thereby ensuring a stable formation of favorable images over an extended period of time.

A first developing device according to the invention comprises a toner carrying member disposed opposite an image bearing member via a gap of 50 to 250 $\mu$m therebetween, and including a conductive substrate and an elastic layer having a rubber hardness of not more than 70 degrees and a thickness of 7 to 50 $\mu$m; and a regulating member pressed against a surface of the toner carrying member for regulating the amount of toner carried on the toner carrying member.

A second developing device according to the invention comprises a toner carrying member disposed opposite an image bearing member via a gap of 50 to 250 $\mu$m therebetween, and including a conductive substrate and an elastic layer having a rubber hardness of not more than 70 degrees and a thickness of 7 to 50 $\mu$m; a regulating member pressed against a surface of the toner carrying member for regulating the amount of toner carried on the toner carrying member; and a power source member for applying an electric field of $1\times10^6$ to $3\times10^7$ V/m between the toner carrying member and the regulating member in a direction to charge the toner in a predetermined polarity.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

A developing device according an embodiment of the invention will be specifically described as below with reference to the accompanying drawings.

Figure 1:
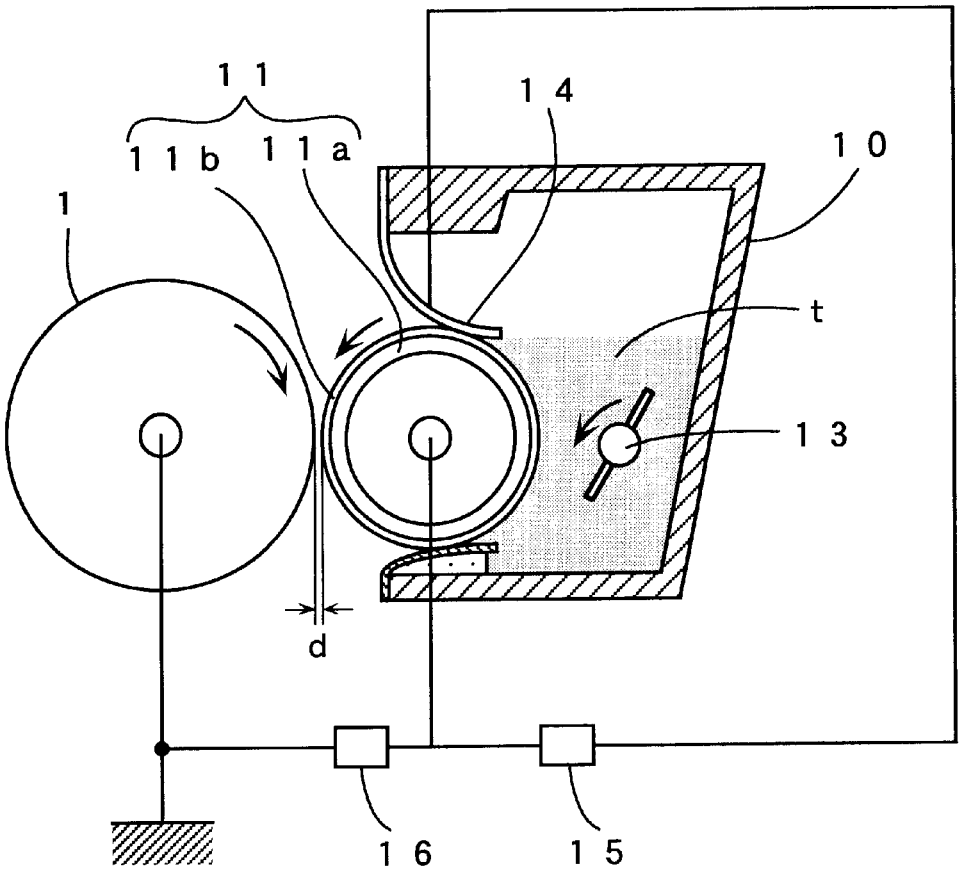
FIG. 1 is a schematic diagram illustrating a developing device according to one embodiment of the invention.

As shown in FIG. 1, the developing device of the embodiment comprises a toner carrying member 11 including a metallic conductive substrate 11*a* shaped like a roller, and an elastic layer 11*b* provided over an outer periphery of the conductive substrate 11*a* and having a rubber hardness of not more than 70 degrees and a thickness of 7 to 50 $\mu$m. The toner carrying member 11 is disposed in a main body 10 of the developing device in a manner to oppose an image bearing member 1 in a development region via a required gap 'd' therebetween. The gap 'd' between the toner carrying member 11 and the image bearing member 1 is defined to range from 50 to 250 $\mu$m.

Figure 2:
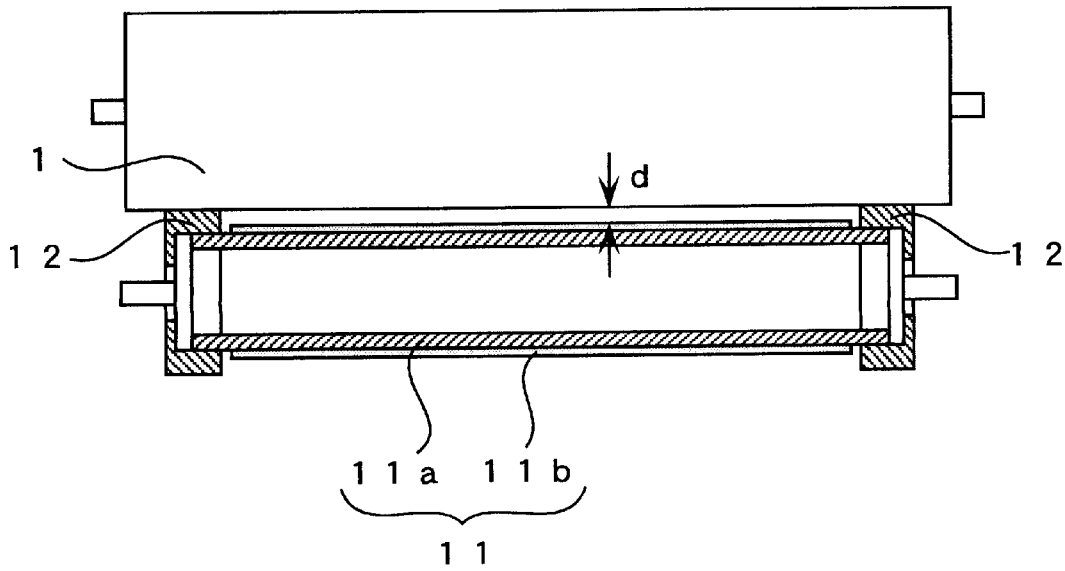
FIG. 2 is a sectional view of the developing device of the above embodiment for illustrating a state in which a toner carrying member opposes an image bearing member in a development region via a required gap therebetween.

The following arrangement is made such that the toner carrying member 11 opposes the image bearing member 1 in the development region via the gap 'd' of 50 to 250 $\mu$m therebetween. As shown in FIG. 2, the conductive substrate 11*a* of the toner carrying member 11 is formed with the elastic layer 11*b* on its outer periphery except for axially opposite ends thereof. A spacer member 12 is attached to each of the outer peripheries of the axially opposite ends of the conductive substrate 11*a* and is abutted against an outer periphery of the image bearing member 1, so as to permit the adjustment of the gap 'd' between the toner carrying member 11 and the image bearing member 1.

While the toner carrying member 11 is rotated, a toner feed member 13 in the device body 10 is rotated so as to feed a toner t stored in the device body 10 to a surface of the rotated toner carrying member 11.

At some place in the course in which the toner t thus fed to the surface of the toner carrying member 11 is transported to the development region where the toner carrying member opposes the image bearing member 1 via the required gap 'd' therebetween, a regulating member 14, disposed in the device body 10, is pressed against the surface of the toner carrying member 11. On the other hand, a predetermined voltage from a regulating bias source 15 is applied to the regulating member 14 for applying an electric field of $1\times10^6$ to $3\times10^7$ V/m between the regulating member 14 and the toner carrying member 11 in a direction to charge the toner t in a predetermined polarity. Thus, the regulating member 14 is adapted to regulate the amount of toner t carried on the toner carrying member 11 to the development region as well as to charge the toner t on the surface of the toner carrying member 11 in the predetermined polarity.

The following effect may be obtained by applying the electric field of $1\times10^6$ to $3\times10^6$ V/m between the regulating member 14 and the toner carrying member 11 in the direction to charge the toner t in the predetermined polarity. That is, electrical leakage between the toner carrying member 11 and the regulating member 14 is suppressed so that the elastic layer 11*b* does not suffer electrical breakdown. Hence, the regulating member 14 is able to charge the toner t properly.

The regulated amount of properly charged toner t is transported by the toner carrying member 11 to the development region where the toner carrying member 11 opposes the image bearing member 1 via the required gap 'd'. On the other hand, a developing bias source 16 applies a developing bias to the toner carrying member 11 for producing an alternating electric field between the toner carrying member 11 and the image bearing member 1, the developing bias obtained by superimposing an AC voltage on a DC voltage. The alternating electric field causes the toner t, transported to the development region by the toner carrying member 11, to jump from the toner carrying member 11 to the image bearing member 1, thus supplying the toner t to a latent image formed on the image bearing member 1 for developing the image.

The developing device of the embodiment is designed such that the gap 'd' between the image bearing member 1 and the toner carrying member 11 opposing each other in the development region is limited to 250 $\mu$m or less. Therefore, the device is adapted to develop an image in a stable manner despite the variations of the gap 'd' between the toner carrying member 11 and the image bearing member 1. As a result, favorable images suffering little density variations or the like are provided. Furthermore, the above device is designed to limit the gap 'd' to 50 $\mu$m or more such that the toner carrying member 11 in the development region is less liable to release insufficiently or inversely charged toner particles therefrom. This results in the prevention of scattered toner or fog. The above gap 'd' preferably ranges from 60 to 200 $\mu$m or more preferably from 70 to 180 $\mu$m.

In the toner carrying member 11, the thickness of the elastic layer 11*b* over the outer periphery of the conductive substrate 11*a* is limited to 50 $\mu$m or less, such that the elastic layer 11*b* may not suffer thickness variations, which will lead to the variations of the gap 'd' between the toner carrying member 11 and the image bearing member 1. As a result, a stable electric filed is produced between the toner carrying member 11 and the image bearing member 1.

In the above arrangement, the elastic layer 11*b* of the toner carrying member 11 has a rubber hardness of not more than 70 degrees and a thickness of not less than 7 $\mu$m. Therefore, when the regulating member 14 is pressed against the surface of the toner carrying member 11 for regulation of the amount of toner t transported to the development region, the toner t is subjected to a decreased load from the elastic layer so that the toner t is prevented from being fractured to produce fine toner particles. This leads to the reduction of the toner particles t fused to the surface of the toner carrying member 11 and the like, contributing to the prevention of the occurrence of streaking or the like in the resultant image. The rubber hardness of the elastic layer preferably ranges from 10 to 70 degrees, more preferably from 15 to 55 degrees or still more preferably from 15 to 50 degrees. It is noted that the above rubber hardness is determined according to JIS K6301.

In the developing device of the embodiment designed to regulate the amount of toner t transported to the development region by means of the regulating member 14 pressed against the surface of the toner carrying member 11, there may be attained a greater effect to prevent the production of toner fine particles resulting from the toner fracture caused by the pressure contact by the regulating member 14 if the contact pressure of the regulating member 14 is limited within the range of 5 to 50 N/m or preferably of 8 to 30 N/m, or if a toner having an average roundness of not less than 0.940 is used.

The average roundness of the above toner t was determined as follows. A flow-type particle size analyzer (FPIA- 2000 commercially available from Sysmex Corp.) was used to measure the length of a circumference of a projected image of a toner particle in an aqueous dispersion system. There was determined the length of a circumference of a circle having an equal area to that of the projected image of the toner particle. The roundness of the toner particle was calculated using the following expression:

Roundness=Circumference of circle of equal area to that of projected image of toner particle/Circumference of projected image of toner particle The resultant roundness was used to determine the average roundness of the toner t.

In the developing device of the embodiment, if the toner carrying member 11 formed with the elastic layer 11*b* has too small a surface roughness, the toner carrying member 11 is able to carry such a small amount of toner t on its surface that an image sufficient in image density cannot be obtained. If, on the other hand, the toner carrying member 11 has too great a surface roughness, the toner carrying member 11 carries such a great amount of toner t on its surface that the toner t is not properly charged. Hence, the resultant image tends to suffer fog. Accordingly, the toner carrying member 11 formed with the elastic layer 11*b* may preferably have an arithmetical average surface roughness Ra in the range of 0.5 to 2.0 m.

Where the developing device of the embodiment uses a negatively chargeable toner t, the toner carrying member 11 may preferably have a work function at its surface in the range of 4.30 to 5.00 eV such that the negatively chargeable toner t may be charged more properly.

If the toner carrying member has an electrical resistance in the range of $1\times10^{6}$ to $5\times10^{10}$ Ω, the electrical leakage between the toner carrying member and the regulating member is more positively prevented when the electric field is applied between the toner carrying member and the regulating member for charging the toner. In addition, the toner carrying member opposing the image bearing member in the development region via the required gap therebetween is able to supply a sufficient amount of toner to the image bearing member for developing an image sufficient in image density.

Examples of an elastic material for forming the elastic layer on the surface of the toner carrying member include a variety of thermoplastic elastomers such as of polystyrene, polyolefin, polyurethane, polyester, polyvinyl chloride, polybutadiene, polyamide and the like; and vulcanized rubbers such as natural rubber, cis-polyisoprene, styrene-butadiene rubber, cis-polybutadiene, chloroprene rubber, butyl rubber, nitrile rubber, ethylene-propylene rubber, acrylic rubber, urethane rubber, silicone rubber and the like. Where the negatively chargeable toner is used, in particular, the elastic layer may preferably be formed from a polyurethane-based elastomer, polyamide-based elastomer, nitrile rubber or urethane rubber in order to provide for the proper charging of the toner.

For proper charging of the toner, the elastic layer over the surface of the toner carrying member may further contain an electroconductivity imparting agent, chargeability imparting agent, roughness imparting material or the like.

Examples of a usable elctroconductivity imparting agent include carbon blacks such as Ketchen black, acetylene black, furnace black and the like; fine particles of metal oxides; and ionic conductive materials. These materials may be used alone or in combination of two or more types.

Examples of a usable chargeability imparting agent include nigrosine dyes, triphenylmethane dyes, Kalex allene dyes, quaternary ammonium salts, imidazole and the like. These materials may be used alone or in combination of two or more types.

Examples of a usable roughness imparting material include fine particles such as of various types of resins or metal oxides, silica, a variety of fillers and the like. These materials may be used alone or in combination of two or more types.

In the developing device according to the above embodiment, an experiment was conducted using toner carrying members 11 formed with various types of elastic layers 11*b* over the respective surfaces thereof. The experiment was intended to demonstrate that the developing device of the embodiment satisfying the conditions of the invention is adapted to reduce the fracture of the toner t thereby ensuring a stable formation of images decreased in density variations or fog.

EXAMPLE 1

A coating solution for elastic layer was prepared as follows. A mixture was prepared by kneading 200 parts by weight of styrene-based thermoplastic elastomer having a rubber hardness of 15 degrees, 10 parts by weight of nigrosine as an electrification-controlling agent, and 15 parts by weight of acetylene black as a conductive material. Subsequently, the kneaded mixture was dissolved in 1000 parts by weight of toluene.

Then, an aluminum conductive substrate 11*a* shaped like a roller was dipped in the coating solution and was withdrawn at a rate of 2.4 mm/s thereby to apply the solution over an outer periphery of the conductive substrate 11*a*. A toner carrying member 11 was obtained by drying the resultant coating film constituting an elastic layer 11*b* having a thickness of 30 μm. It is noted that the elastic layer 11*b* had a rubber hardness of 18 degrees.

EXAMPLE 2

A coating solution for elastic layer was prepared as follows. A mixture was prepared by kneading 100 parts by weight of styrene-based thermoplastic elastomer having a rubber hardness of 15 degrees, 100 parts by weight of styrene-based thermoplastic elastomer having a rubber hardness of 61 degrees, 10 parts by weight of nigrosine as the electrification-controlling agent, and 20 parts by weight of acetylene black as the conductive material. Subsequently, the kneaded mixture was dissolved in 1000 parts by weight of toluene.

Then, an aluminum conductive substrate 11*a* shaped like a roller was dipped in the coating solution and was withdrawn at a rate of 2.4 mm/s thereby to apply the solution over an outer periphery of the conductive substrate 11*a*. A toner carrying member 11 was obtained by drying the resultant coating film constituting an elastic layer 11*b* having a thickness of 30 μm. It is noted that the elastic layer 11*b* had a rubber hardness of 44 degrees.

EXAMPLE 3

A coating solution for elastic layer was prepared as follows. A mixture was prepared by kneading 200 parts by weight of styrene-based thermoplastic elastomer having a rubber hardness of 61 degrees, 10 parts by weight of nigrosine as the electrification-controlling agent, and 20 parts by weight of acetylene black as the conductive material. Subsequently, the kneaded mixture was dissolved in 1000 parts by weight of toluene.

Then, an aluminum conductive substrate 11*a* shaped like a roller was dipped in the coating solution and was withdrawn at a rate of 2.4 mm/s thereby to apply the solution over an outer periphery of the conductive substrate 11*a*. A toner carrying member 11 was obtained by drying the resultant coating film constituting an elastic layer 11*b* having a thickness of 30 μm. It is noted that the elastic layer 11*b* had a rubber hardness of 68 degrees.

Comparative Example 1

A coating solution for elastic layer was prepared as follows. A mixture was prepared by kneading 70 parts by weight of styrene-based thermoplastic elastomer having a rubber hardness of 61 degrees, 130 parts by weight of butadiene-based thermoplastic elastomer having a rubber hardness of 95 degrees, 10 parts by weight of nigrosine as the electrification-controlling agent, and 2 parts by weight of Ketchen black as a conductive material. Subsequently, the kneaded mixture was dissolved in 1000 parts by weight of toluene.

Then, an aluminum conductive substrate 11*a* shaped like a roller was dipped in the coating solution and was withdrawn at a rate of 2.4 mm/s thereby to apply the solution over an outer periphery of the conductive substrate 11*a*. A toner carrying member 11 was obtained by drying the resultant coating film constituting an elastic layer 11*b* having a thickness of 30 μm. It is noted that the elastic layer 11*b* had a rubber hardness of 85 degrees.

Comparative Example 2

A coating solution for elastic layer was prepared as follows. A mixture was prepared by kneading 200 parts by weight of butadiene-based thermoplastic elastomer having a rubber hardness of 95 degrees, 10 parts by weight of nigrosine as the electrification-controlling agent, and 2 parts by weight of Ketchen black as the conductive material. Subsequently, the kneaded mixture was dissolved in 1000 parts by weight of toluene.

Then, an aluminum conductive substrate 11*a* shaped like a roller was dipped in the coating solution and was withdrawn at a rate of 2.4 mm/s thereby to apply the solution over an outer periphery of the conductive substrate 11*a*. A toner carrying member 11 was obtained by drying the resultant coating film constituting an elastic layer 11*b* having a thickness of 30 μm. It is noted that the elastic layer 11*b* had a rubber hardness of 96 degrees.

The toner t was a negatively chargeable toner T1 prepared as follows.

A Henschel mixer was operated at 2800 rpm for 3 minutes for mixing 100 parts by weight of polyester resin (TUFTONE NE-1110 commercially available from Kao Corp.), 8 parts by weight of carbon black (Mogul L commercially available from Cabot Inc.), 3 parts by weight of electrification-controlling agent (BONTRON S-34 commercially available from Orient Industry Co.,Ltd.), and 2.5 parts by weight of lubricant (BISCOL TS-200 commercially available from Sanyo Chemical Industries Ltd.). The mixture was kneaded by a twin-screw extruder/kneader and was cooled. Subsequently, the kneaded mixture was roughly milled and then pulverized by a jet pulverizer (IDS commercially available from Japan Pneumatic Industries Co., Ltd.). The resultant particles were classified by DS classifier thereby to obtain toner particles. The resultant toner particles were admixed with 0.8 wt % of hydrophobic silica (CABOSIL TS-500 commercially available from Cabot Inc.) and blended together by a Henschel mixer operated at 2500 rpm for 90 seconds. Thus was obtained the negatively chargeable toner T1 having a volume-average particle size of 8.5 μm and an average roundness of 0.938.

Each of the toner carrying members 11 of Examples 1–3 and Comparative Examples 1–2 was allowed to carry the resultant toner T1 on its surface. Each toner carrying member 11 was rotated at a circumferential speed of 240 mm/s with an SUS regulating member 14 pressed against its surface at a linear pressure of 50 N/m. In this state, each toner carrying member 11 was rotated through 250 revolutions.

Before and after the rotation through 250 revolutions with the regulating member 14 pressed against each toner carrying member, the toner carrying member 11 was examined for the proportion of fine toner particles 5.0 μm or less in size which were contained in the toner T1 carried on the surface thereof. There was determined the increase percentage of the fine toner particles after the rotation through 250 revolutions. The results are listed in Table 1 as below.

TABLE 1

| | type of elastic layer | | increase percentage of |
|---|---|---|---|
| | rubber hardness (degree) | thickness (μm) | fine toner particles (%) |
| example 1 | 18 | 30 | 4 |
| example 2 | 44 | 30 | 5 |
| example 3 | 68 | 30 | 5.5 |
| comparative example 1 | 85 | 30 | 16 |
| comparative example 2 | 96 | 30 | 30 |

As apparent from the results, the increase percentages of the fine toner particles were much lower in the toner carrying members 11 of Examples 1–3 wherein the elastic layers formed on their surfaces had the rubber hardnesses of not more than 70 degrees, as compared with those of Comparative Examples 1–2 wherein the elastic layers had the rubber hardnesses of above 70 degrees.

EXAMPLE 4

A toner carrying member 11 formed with an elastic layer 11*b* on an outer periphery of its conductive substrate 11*a* was fabricated the same way as in Example 1, except that the conductive substrate 11*a* was withdrawn from the above coating solution for elastic layer at a rate of 1.6 mm/s. The elastic layer 11*b* had a rubber hardness of 18 degrees and a thickness of 20 μm.

EXAMPLE 5

A toner carrying member 11 formed with an elastic layer 11*b* on an outer periphery of its conductive substrate 11*a* was fabricated the same way as in Example 1, except that the kneaded mixture of Example 1 was dissolved in 2000 parts by weight of toluene. The elastic layer had a rubber hardness of 18 degrees and a thickness of 11 μm.

Comparative Example 3

A toner carrying member 11 formed with an elastic layer 11*b* on an outer periphery of its conductive substrate 11*a* was fabricated the same way as in Example 1, except that the kneaded mixture of Example 1 was dissolved in 2000 parts by weight of toluene and that the conductive substrate 11*a* was withdrawn from the coating solution for elastic layer at a rate of 1.0 mm/s. The elastic layer had a rubber hardness of 18 degrees and a thickness of 4 μm.

EXAMPLE 6

A toner carrying member 11 formed with an elastic layer 11*b* on an outer periphery of its conductive substrate 11*a* was fabricated the same way as in Example 2, except that the conductive substrate 11*a* was withdrawn from the above coating solution for elastic layer at a rate of 1.4 mm/s. The elastic layer 11*b* had a rubber hardness of 44 degrees and a thickness of 17 μm.

EXAMPLE 7

A toner carrying member 11 formed with an elastic layer 11*b* on an outer periphery of its conductive substrate 11*a* was fabricated the same way as in Example 2, except that the kneaded mixture of Example 2 was dissolved in 2000 parts by weight of toluene. The elastic layer had a rubber hardness of 44 degrees and a thickness of 10 μm.

Comparative Example 4

A toner carrying member 11 formed with an elastic layer 11*b* on an outer periphery of its conductive substrate 11*a* was fabricated the same way as in Example 2, except that the kneaded mixture of Example 2 was dissolved in 2000 parts by weight of toluene and that the conductive substrate 11*a* was withdrawn from the coating solution for elastic layer at a rate of 1.0 mm/s. The elastic layer had a rubber hardness of 44 degrees and a thickness of 3 μm.

EXAMPLE 8

A toner carrying member 11 formed with an elastic layer 11*b* on an outer periphery of its conductive substrate 11*a* was fabricated the same way as in Example 3, except that the conductive substrate 11*a* was withdrawn from the above coating solution for elastic layer at a rate of 1.4 mm/s. The elastic layer 11*b* had a rubber hardness of 68 degrees and a thickness of 18 μm.

EXAMPLE 9

A toner carrying member 11 formed with an elastic layer 11*b* on an outer periphery of its conductive substrate 11*a* was fabricated the same way as in Example 3, except that the kneaded mixture of Example 3 was dissolved in 2000 parts by weight of toluene. The elastic layer had a rubber hardness of 68 degrees and a thickness of 7 μm.

Comparative Example 5

A toner carrying member 11 formed with an elastic layer 11*b* on an outer periphery of its conductive substrate 11*a* was fabricated the same way as in Comparative Example 2, except that the conductive substrate 11*a* was withdrawn from the above coating solution for elastic layer at a rate of 1.6 mm/s. The elastic layer 11*b* had a rubber hardness of 96 degrees and a thickness of 20 μm.

Comparative Example 6

A toner carrying member 11 formed with an elastic layer 11*b* on an outer periphery of its conductive substrate 11*a* was fabricated the same way as in Comparative Example 2, except that the kneaded mixture of Comparative Example 2 was dissolved in 2000 parts by weight of toluene. The elastic layer had a rubber hardness of 96 degrees and a thickness of 8 μm.

Comparative Example 7

A toner carrying member 11 formed with an elastic layer 11*b* on an outer periphery of its conductive substrate 11*a* was fabricated the same way as in Example 2, except that the operation for applying the coating solution for elastic layer to an outer periphery of the conductive substrate 11*a* was carried out twice. The elastic layer had a rubber hardness of 44 degrees and a thickness of 58 μm.

Developing devices of Examples 4–9 and Comparative Examples 3–7 used their respective toner carrying members 11 and the aforesaid negatively chargeable toner T1. The SUS regulating member 14 was pressed against a surface of each toner carrying member 11 at a linear pressure of 50 N/m.

The developing devices of Examples 4–9 and Comparative Examples 3–7 were each mounted in a commercial printer (LP-3000C commercially available from Epson Corp.) which was operated at a rate of 20 sheets/min to print an image on 10000 sheets of A-4 size. The resultant images were examined for streaking and evaluated. The results are listed in Table 2 as below, in which ○ denotes an image free from streaking and X denotes an image sustaining streaking.

TABLE 2

| | type of elastic layer | | |
|---|---|---|---|
| | rubber hardness (degree) | thickness (μm) | streaking |
| example 4 | 18 | 20 | ○ |
| example 5 | 18 | 11 | ○ |
| example 6 | 44 | 17 | ○ |
| example 7 | 44 | 10 | ○ |
| example 8 | 68 | 18 | ○ |
| example 9 | 68 | 7 | ○ |
| comparative example 3 | 18 | 4 | X |
| comparative example 4 | 44 | 3 | X |
| comparative example 5 | 96 | 20 | X |
| comparative example 6 | 96 | 8 | X |
| comparative example 7 | 44 | 58 | X |

As apparent from the results, 10000 favorable images free from streaking were achieved by the developing devices of Examples 4–9 which included the toner carrying members 11 formed with the elastic layers 11*b* having the rubber hardnesses of not more than 70 degrees and the thicknesses of not less than 7 μm.

In contrast, the developing devices of Comparative Examples 3–4 including the toner carrying members 11 formed with the elastic layers 11*b* which were not more than 70 degrees in rubber hardness but less than 7 μm in thickness, and those of Comparative Examples 5–6 including the toner carrying members 11 formed with the elastic layers 11*b* having the rubber hardnesses of more than 70 degrees, all encountered the fusion of the fine toner particles to the toner carrying members or regulating members thereof during the production of 10000 prints. The streaking was observed in the resultant images. Furthermore, the streaking was also observed in the images provided by the developing device of Comparative Example 7 wherein the elastic layer 11*b* had the thickness of 58 μm.

EXAMPLE 10

A coating solution for elastic layer was prepared by blending together 100 parts by weight of commercial urethane emulsion (IODOSOL available from Japan NSC Co.Ltd.), 5 parts by weight of Ketchen black as the conductive material, and 2.3 parts by weight of EPOSTER MA1010 (NIPPON SHOKUBAI Co., Ltd.) as a roughness imparting material. The resultant coating solution was applied to an outer periphery of an aluminum conductive substrate 11*a* shaped like a roller and then dried. Thus was fabricated a toner carrying member 11 formed with an elastic layer 11*b* in the thickness of 27 μm. The elastic layer 11*b* had a rubber hardness of 50 degrees and an arithmetical average surface roughness Ra Of 0.54 m.

EXAMPLE 11

A toner carrying member 11 formed with an elastic layer 11*b* on an outer periphery of its conductive substrate 11*a* was fabricated the same way as in Example 10, except that the amount of Eposter MA1010 (NIPPON SHOKUBAI Co., Ltd.) was changed to 4.6 parts by weight and that the thickness of the elastic layer 11*b* was adjusted to 32 μm. The elastic layer 11*b* had a rubber hardness of 53 degrees and an average arithmetical surface roughness Ra of 0.86 m.

EXAMPLE 12

A toner carrying member 11 formed with an elastic layer 11*b* on an outer periphery of its conductive substrate 11*a* was fabricated the same way as in Example 10, except that the amount of Eposter MA1010 (NIPPON SHOKUBAI Co., Ltd.) was changed to 5.9 parts by weight and that the thickness of the elastic layer 11*b* was adjusted to 30 μm. The elastic layer 11*b* had a rubber hardness of 52 degrees and an average arithmetical surface roughness Ra of 1.35 m.

EXAMPLE 13

A toner carrying member 11 formed with an elastic layer 11*b* on an outer periphery of its conductive substrate 11*a* was fabricated the same way as in Example 10, except that the amount of Eposter MA1010 (NIPPON SHOKUBAI Co., Ltd.) was changed to 7.3 parts by weight and that the thickness of the elastic layer 11*b* was adjusted to 34 μm. The elastic layer 11*b* had a rubber hardness of 55 degrees and an average arithmetical surface roughness Ra of 1.88 m.

Developing devices of Examples 10–13 used their respective toner carrying members 11 and the aforesaid negatively chargeable toner T1. The SUS regulating member 14 was pressed against a surface of each toner carrying member 11 at a linear pressure of 30 N/m.

The developing devices of Examples 10–13 were each mounted in a commercial printer (LP-3000C available from Epson Corp.) wherein the circumferential speed of the toner carrying member 11 was set to 1.5 times the circumferential speed of the image bearing member 1. The printers were each operated at a rate of 20 sheets/min to print an image on 10000 sheets of A-4 size. The resultant images were examined for image density and fog and evaluated. The results are listed in Table 3 as below.

As to the image density, ○ denotes an image having an image density of 1.2 or more whereas X denotes an image having an image density of less than 1.2.

As to the fog, ○ denotes an image free from the fog whereas X denotes an image sustaining the fog.

TABLE 3

| | type of elastic layer | | | | |
|---|---|---|---|---|---|
| | rubber hardness (degree) | thickness (μm) | Ra (μm) | image density | fog |
| example 10 | 50 | 27 | 0.54 | ○ | ○ |
| example 11 | 53 | 32 | 0.86 | ○ | ○ |
| example 12 | 52 | 30 | 1.35 | ○ | ○ |
| example 13 | 55 | 34 | 1.88 | ○ | ○ |

EXAMPLE 14

A toner carrying member 11 formed with an elastic layer 11*b* on an outer periphery of its conductive substrate 11*a* was fabricated the same way as in Example 11, except that 5 parts by weight of acetylene black was used in place of Ketchen black and that the thickness of the elastic layer 11*b* was adjusted to 30 μm. The elastic layer 11*b* had a rubber hardness of 53 degrees and a work function of 4.38 eV.

EXAMPLE 15

A coating solution for elastic layer was prepared by blending together 100 parts by weight of commercial acrylonitrile-butadiene copolymer rubber containing a carboxyl group (NIPOL 1072J available from Zeon Corporation), 20 parts by weight of Ketchen black as the conductive material, 5 parts by weight of zinc white, and 4.6 parts by weight of Eposter MA1010 (NIPPON SHOKUBAI Co., Ltd.) as the roughness imparting material, and then dissolving or dispersing the resultant mixture in toluene.

The resultant coating solution was applied to an aluminum conductive substrate shaped like a roller and then dried. Thus was fabricated a toner carrying member formed with an elastic layer 11*b* in a thickness of 30 μm. The elastic layer 11*b* had a rubber hardness of 48 degrees and a work function of 4.65 eV.

EXAMPLE 16

A toner carrying member 11 formed with a 30 μm-thick elastic layer 11*b* on an outer periphery of its conductive substrate 11*a* was fabricated the same way as in Example 15, except that 25 parts by weight of acetylene black was used in place of Ketchen black. The elastic layer 11*b* had a rubber hardness of 49 degrees and a work function of 4.80 eV.

EXAMPLE 17

A toner carrying member 11 formed with a 30 μm-thick elastic layer 11*b* on an outer periphery of its conductive substrate 11*a* was fabricated the same way as in Example 16, except that the commercial acrylonitrile-butadiene copolymer rubber (NIPOL 1072J available from Zeon Corporation) was replaced by a commercial acrylonitrile-butadiene copolymer rubber (NIPOL DN207 available from Zeon Corporation). The elastic layer 11*b* had a rubber hardness of 49 degrees and a work function of 5.01 eV.

Developing devices of Examples 10–13 used their respective toner carrying members 11 and the aforesaid negatively chargeable toner T1. The SUS regulating member 14 was pressed against a surface of each toner carrying member 11 at a linear pressure of 30 N/m.

The developing devices of Examples 14–17 were each mounted in a commercial printer (LP-3000C available from Epson Corp.) which was operated at a rate of 20 sheets/min to print an image on 10000 sheets of A-4 size. Each toner carrying member 11 was examined for toner filming on its surface whereas the resultant images were examined for fog. The results are listed in Table 4 as below.

As to the toner filming on the surface of the toner carrying member 11, ○ denotes a toner carrying member free from the toner filming whereas X denotes a toner carrying member suffering the toner filming.

As to the fog, ○ denotes an image free from the fog whereas X denotes an image sustaining the fog.

TABLE 4

| | type of elastic layer | | | | |
|---|---|---|---|---|---|
| | rubber hardness (degree) | thickness (μm) | work function (eV) | filming | fog |
| example 14 | 53 | 30 | 4.38 | ○ | ○ |
| example 15 | 48 | 30 | 4.65 | ○ | ○ |
| example 16 | 49 | 30 | 4.80 | ○ | ○ |
| example 17 | 49 | 30 | 5.01 | ○ | ○ |

EXAMPLES 18–20

A toner carrying member formed with an elastic layer 11*b* on an outer periphery of its conductive substrate 11*a* was fabricated the same way as in Example 11, except that the thickness of the elastic layer 11*b* was adjusted to 30 μm. The elastic layer 11*b* had a rubber hardness of 53 degrees.

Example 18 used the aforesaid toner T1 having a volume-average particle size of 8.5 μm and an average roundness of 0.938.

Example 19 used a negatively chargeable toner T2 prepared the same way as in the preparation of the toner T1, except that the jet pulverizer was replaced by an inomizer (INM-30 commercially available from Hosokawamicron Corporation) and the DS classifier was replaced by a rotor-type classifier (100ATP commercially available from Hosokawamicron Corporation). The toner T2 had a volume-average particle size of 8.5 μm and an average roundness of 0.953.

Example 20 used a negatively chargeable toner T3 prepared the same way as in the preparation of the toner T1, except that the aforesaid procedure for preparing the negatively chargeable toner T1 was followed by treating the resultant toner particles by a hybridization system (HS-3 commercially available from Nara Machinery Co.,Ltd.) which was operated at 6000 rpm for 5 minutes. The toner T3 had a volume-average particle size of 8.5 μm and an average roundness of 0.963.

In the developing devices of Examples 18–20, the SUS regulating members 14 were pressed against the surfaces of the toner carrying members 11 at linear pressures varied in the range of 10 to 50 N/m as listed in Table 5 as below. The developing devices were each mounted in a commercial printer (LP-3000C available from Epson Corp.) which was operated at a rate of 30 sheets/min to print an image on 5000 sheets of A-4 size. The resultant images were examined for fog. The results are listed in Table 5, in which ○ denotes an image free from the fog whereas X denotes an image sustaining the fog.

TABLE 5

| | type of elastic layer | | | fog | | | | |
|---|---|---|---|---|---|---|---|---|
| | rubber hardness | thickness | toner | linear pressure of regulating member | | | | |
| | (degree) | (μm) | roundness | 10 | 20 | 30 | 40 | 50 |
| example 18 | 53 | 30 | 0.938 | ○ | ○ | ○ | X | X |
| example 19 | 53 | 30 | 0.953 | ○ | ○ | ○ | ○ | ○ |
| example 20 | 53 | 30 | 0.968 | ○ | ○ | ○ | ○ | ○ |

The results show that in Examples 19–20 using the negatively chargeable toners T2, T3 having the average roundnesses of not less than 0.940, favorable fog-free images were obtained when a large number of images were produced with the regulating member 14 pressed against the surface of the toner carrying member 11 at such a high linear pressure of 50 N/m. On the other hand, in Example 18 using the negatively chargeable toner T1 having the average roundness of 0.938, the process for producing a large number of images with the regulating member 14 pressed against the surface of the toner carrying member 11 at a linear pressure of not less than 40 N/m resulted in fogged images. However, when the linear pressure of the regulating member 14 pressed against the surface of the toner carrying member 11 is not more than 30 N/m, favorable fog-free images were obtained.

Experiment A

Experiment A used the aforesaid developing device wherein the toner carrying member 11 was formed with an elastic layer 11*b* on its surface and had an electrical resistance of $1\times10^8$ Ω, the layer 11*b* having a rubber hardness of 55 degrees and a thickness of 30 μm.

Experiment A was conducted as follows. The regulating member 14 was pressed against the surface of the toner carrying member 11 for regulating the amount of toner t transported to the development region. On the other hand, the aforesaid regulating bias source 15 applied a voltage 100 V lower than that of the toner regulating member 14 to the regulating member 14 thereby applying an electric field of $1\times10^7$ V/m between the regulating member 14 and the toner carrying member 11 such that the toner t may be charged in the predetermined polarity. The toner t was the aforesaid negatively chargeable toner T1.

Figure 3:
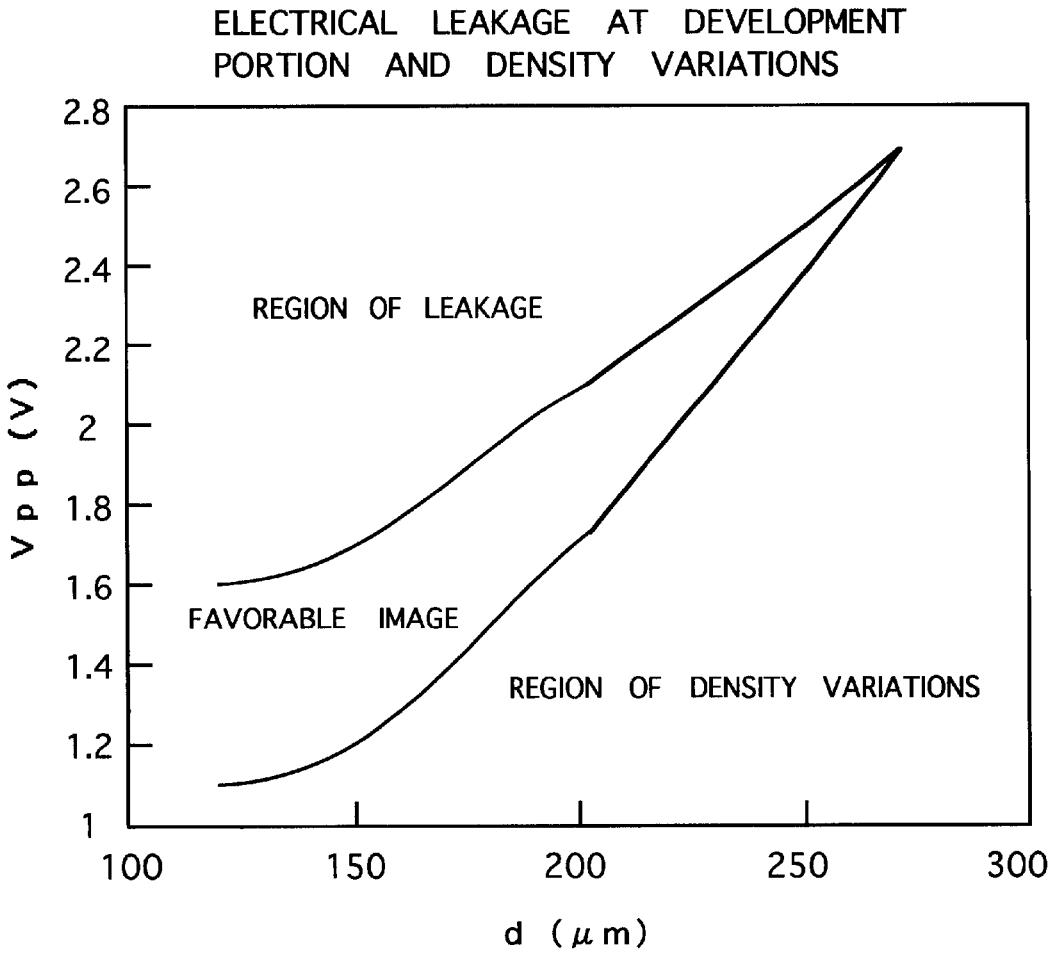
FIG. 3 is a graph showing the results of Experiment A for evaluation of images which were developed with varied gaps 'd' between the toner carrying member and the image bearing member and varied developing biases applied to the toner carrying member by a developing bias source.

The gap 'd' between the toner carrying member 11 and the image bearing member 1 was varied whereas the toner carrying member 11 was applied with a developing bias from the developing bias source 16, the developing bias so varied as to achieve an image sufficient in image density. That is, images were formed with the DC voltage varied in the range of 330 to 470 V and with the AC voltage set at a frequency of 2 kHz and varied in peak-to-peak value Vpp in the range of 1.1 to 2.7 kV and in duty on the development side in the range of 30 to 40%. The resultant images were examined for density variations as well as for noises due to the electrical leakage between the toner carrying member 11 and the image bearing member 1. The results are graphically shown in FIG. 3.

According to the results, when the gap 'd' between the toner carrying member 11 and the image bearing member 1 is 250 μm or more, all the resultant images suffered the density variations or the noises due to the electrical leakage no matter how the developing bias from the developing bias source 16 was changed.

Experiment B

Similarly to Experiment A, Experiment B used the toner carrying member 11 which was formed with the elastic layer 11*b* on its surface and had the electrical resistance of $1\times10^8$ Ω, the layer 11*b* having the rubber hardness of 55 degrees and the thickness of 30 μm.

Experiment B was conducted as follows. The SUS regulating member 14 was pressed against the surface of the toner carrying member 11. On the other hand, in the process for applying a voltage from the regulating bias source 15 to the regulating member 14 thereby charging the toner t in the predetermined polarity, the electric field which was varied in the range of $5.00\times10^5$ to $5.00\times10^7$ V/m was applied between the regulating member 14 and the toner carrying member 11, as shown in Table 6. The toner t was the aforesaid negatively chargeable toner T1.

Subsequent to the process for regulating the amount of toner t on the surface of the toner carrying member 11 and charging the toner t, the following developing process was performed for forming images. The gap 'd' between the toner carrying member 11 and the image bearing member 1 was set to 150 μm. A developing bias from the aforesaid developing source 16 was applied to the toner carrying member 11, the developing bias obtained by superimposing an AC voltage having a frequency of 2 kHz, a peak-to-peak value Vpp of 1.6 kV and a duty on the development side of 33% on a DC voltage of 400 V.

The resultant images were examined for streaking noises due to the electrical leakage between the regulating member 14 and the toner carrying member 11. The results are listed in Table 6, in which ○ denotes an image free from the streaking noises whereas X denotes an image sustaining the streaking noises. The images were also examined for fog and the results are also listed in Table 6, in which ○ denotes an image free from the fog whereas X denotes an image sustaining the fog.

TABLE 6

| evaluation | electric field between regulating member and toner carrying member (V/m) | | | | |
|---|---|---|---|---|---|
| items | $5.00\times10^5$ | $1.00\times10^6$ | $1.00\times10^7$ | $3.00\times10^7$ | $5.00\times10^7$ |
| streaking noise | ○ | ○ | ○ | ○ | X |
| fog | X | ○ | ○ | ○ | ○ |

Experiment C

Experiment C used a toner carrying member 11 which was formed with the same elastic layer 11 as in Experiment A on its surface, the layer having the rubber hardness of 55 degrees and the thickness of 30 μm, and which was varied in electrical resistance in the range of $1.00\times10^5$ to $1.00\times10^{11}$ Ω, as listed in Table 7.

Experiment C was conducted as follows. The SUS regulating member 14 was pressed against the surface of the toner carrying member 11. The regulating bias source 15 applied, to the regulating member 14, a voltage for charging the toner t in the predetermined polarity, thereby applying an electric field of $1\times10^7$ V/m between the regulating member 14 and the toner carrying member 11. Thus, the amount of toner t carried on the toner carrying member 11 to the development region was regulated while the toner t was charged. The toner t was the aforesaid negatively chargeable toner T1.

Similarly to Experiment B, the gap 'd' between the toner carrying member 11 and the image bearing member 1 was set to 150 μm. The developing bias from the aforesaid developing source 16 was applied to each of the toner carrying members 11, the developing bias obtained by superimposing the AC voltage having the frequency of 2 kHz, the peak-to-peak value Vpp of 1.6 kV and the duty on the development side of 33% on the DC voltage of 400 V. Images were formed in this manner.

The resultant images were examined for streaking noises due to the electrical leakage between the regulating member 14 and the toner carrying member 11. The results are listed in Table 7, in which ○ denotes an image free from the streaking noises whereas X denotes an image sustaining the streaking noises. In addition, each of the images was examined for the density of a solid area thereof using a commercial Macbeth densitometer TD904. The results are listed in Table 7, in which ○ denotes an image having a density of not less than 1.2 whereas X denotes an image having a density of less than 1.2.

TABLE 7

| evaluation | electrical resistance of toner carrying member (Ω) | | | | |
|---|---|---|---|---|---|
| items | $1.00\times10^5$ | $1.00\times10^6$ | $1.00\times10^8$ | $5.00\times10^{10}$ | $1.00\times10^{11}$ |
| streaking noise | X | ○ | ○ | ○ | ○ |
| image density | ○ | ○ | ○ | ○ | X |

Although the present invention has been fully described by way of examples, it is to be noted that various changes and modifications will be apparent to those skilled in the art. Therefore, unless otherwise such changes and modifications depart from the scope of the present invention, they should be construed as being included therein.

What is claimed is:

1. A developing device of monocomponent development system for developing a latent image formed on an image bearing member comprising:

a toner carrying member disposed opposite the image bearing member via a gap of 50 to 250 μm therebetween, and including a conductive substrate and an elastic layer having a rubber hardness of not more than 70 degrees and a thickness in the range of 7 to 50 μm; and a regulating member pressed against a surface of the toner carrying member for regulating the amount of toner on the toner carrying member.

2. The developing device as claimed in claim 1, wherein the gap between the toner carrying member and the image bearing member is in the range of 60 to 200 μm.

3. The developing device as claimed in claim 1, wherein the rubber hardness of the elastic layer is in the range of 15 to 55 degrees.

4. The developing device as claimed in claim 1, wherein the thickness of the elastic layer is in the range of 10 to 40 μm.

5. The developing device as claimed in claim 1, wherein a contact pressure of the regulating member against the toner carrying member is in the range of 5 to 50 N/m.

6. The developing device as claimed in claim 1, wherein a contact pressure of the regulating member against the toner carrying member is in the range of 8 to 30 N/m.

7. The developing device as claimed in claim 1, wherein the toner has an average roundness in the range of 0.940 to 1.

8. The developing device as claimed in claim 1, wherein the elastic layer has an arithmetical average surface roughness Ra in the range of 0.5 to 2.0 μm.

9. The developing device as claimed in claim 1, wherein the toner is a negatively chargeable toner and the elastic layer has a work function at its surface in the range of 4.30 to 5.00 eV.

10. The developing device as claimed in claim 1, wherein the toner carrying member has an electrical resistance in the range of $1\times10^6$ to $5\times10^{10}$ Ω.

11. A developing device of monocomponent development system for developing a latent image formed on an image bearing member comprising:

a toner carrying member disposed opposite the image bearing member via a gap of 50 to 250 μm, and including a conductive substrate and an elastic layer having a rubber hardness of not more than 70 degrees and a thickness in the range of 7 to 50 μm;

a regulating member pressed against a surface of the toner carrying member for regulating the amount of toner on the toner carrying member; and a power source member for applying an electric field of $1\times10^6$ to $3\times10^7$ V/m between the toner carrying member and the regulating member in a direction to charge the toner in a predetermined polarity.

12. The developing device as claimed in claim 11, wherein the gap between the toner carrying member and the image bearing member is in the range of 60 to 200 μm.

13. The developing device as claimed in claim 11, wherein the rubber hardness of the elastic layer is in the range of 15 to 55 degrees.

14. The developing device as claimed in claim 11, wherein the thickness of the elastic layer is in the range of 10 to 40 μm.

15. The developing device as claimed in claim 11, wherein a contact pressure of the regulating member against the toner carrying member is in the range of 5 to 50 N/m.

16. The developing device as claimed in claim 11, wherein a contact pressure of the regulating member against the toner carrying member is in the range of 8 to 30 N/m.

17. The developing device as claimed in claim 11, wherein the toner has an average roundness in the range of 0.940 to 1.

18. The developing device as claimed in claim 11, wherein the elastic layer has an arithmetical average surface roughness Ra in the range of 0.5 to 2.0 μm.

19. The developing device as claimed in claim 11, wherein the toner is a negatively chargeable toner and the elastic layer has a work function at its surface in the range of 4.30 to 5.00 eV.

20. The developing device as claimed in claim 11, wherein the toner carrying member has an electrical resistance in the range of $1\times10^6$ to $5\times10^{10}$ Ω.

* * * * *